US006810538B2

(12) United States Patent
Ouyoung

(10) Patent No.: US 6,810,538 B2
(45) Date of Patent: Nov. 2, 2004

(54) COUPLING DEVICE FOR SANITARY FITTINGS

(75) Inventor: Scott Ouyoung, Taichung (TW)

(73) Assignee: Globe Union Industrial Corp., Taichung (TW)

( * ) Notice: Subject to any disclaimer, the term of this patent is extended or adjusted under 35 U.S.C. 154(b) by 0 days.

(21) Appl. No.: 10/400,700

(22) Filed: Mar. 28, 2003

(65) Prior Publication Data

US 2004/0187204 A1 Sep. 30, 2004

(51) Int. Cl.[7] ..... A47K 3/024
(52) U.S. Cl. ..... 4/576.1; 211/105.1; 248/309.1
(58) Field of Search ..... 4/576.1; 248/215, 248/222.13, 251, 224.8; 211/105.1

(56) References Cited

U.S. PATENT DOCUMENTS 5,402,977 A * 4/1995 Korfgen et al. ..... 248/309.1
6,651,830 B2 * 11/2003 Pan ..... 211/105.1

* cited by examiner

*Primary Examiner*—Charles E. Phillips
(74) *Attorney, Agent, or Firm*—Leong C. Lei

(57) ABSTRACT

A coupling device for a sanitary fitting is disclosed. The present invention relates to a coupling device, and in particular, a coupling device for mounting sanitary fittings such as showering fittings disposed onto the walls of the bathroom.

1 Claim, 5 Drawing Sheets

COUPLING DEVICE FOR SANITARY FITTINGS

BACKGROUND OF THE INVENTION (a) Technical Field of the Invention

The present invention relates to a coupling device, and in particular, a coupling device for mounting sanitary fittings such as fittings used in bathroom walls thereof.

(b) Description of the Prior Art

FIG. 1 shows a conventional sanitary fitting coupling device having a circular securing seat 42 fitted on a mounting surface. The base of a conventional sanitary fitting seat 40 is then inserted onto the external circumferential edge of the securing seat 42 so that the two components are horizontally secured. A positioning screw 41 is inserted into a screw hole on the circumferential edge of the fitting seat 40 to secure the fitting seat 40 to the securing seat 42. There are numerous of drawbacks in the process of installing the sanitary fittings as follows:

(1) Installation procedures are laborious.

The installation processes have to be in such a sequence that the securing seat 42 has to be mounted first and other components of the sanitary fittings are then installed. Then a measuring tool is used to measure whether the fittings are mounted in parallel to the wall. The fitting seat 40 has to be held with one hand and another hand screws the positioning screw 41 to the securing seat 42. Occasionally the hand used to screw the positioning screw 41 moves accidentally, and the measuring process to obtain a parallel position has to be repeated again. Thus the procedure of installation is laborious and time consuming.

(2) Difficulty in positioning.

The positioning of the sanitary fittings depends on the positioning screw 41. As a result, there is no other element to provide support to the sanitary fittings, so the fitting seat may move either horizontally or become dislocated.

(3) Difficulty in dismantling.

In the process of replacing the sanitary fitting, the positioning screw 41 has to be unscrewed, and installation procedures have to be repeated. Thus, the procedures are laborious and are not effective.

SUMMARY OF THE INVENTION

Accordingly, it is an object of the present invention to provide a coupling device for sanitary fittings having a seat body including a main body, and rod body and a hook body, characterized in that the upper end face of the seat body is provided with a positioning slot, and the main body comprises a bottom fastening plate and a top fastening plate, the protruded edge at the front end of the bottom fastening plate is a stepped body and a bottom protruded edge is located at the upper edge side and the bottom edge is a fastening side, the center of the bottom fastening plate corresponding to that of the top fastening plate is a hook-like fasting block having a fastening slot the two sides of the corresponding top and bottom fastening plate are provided with a securing hole for the insertion of screw for mounting, a stepped slot is provided at a recessed region on the top fastening plate corresponding to the bottom fastening plate, and a top protruded edge is located at the side edge, a fastening passage is formed within the recessed region of the top fastening plate, difference in height between the top protruded edge and the fastening passage, and the bottom protruded edge of the bottom fastening plate and the fastening side are fastened to each other, a recessed passage is provided at one recessed end face formed on the top fastening plate corresponding to the bottom fastening plate, one side of the recessed passage is two positioning sides which are in parallel and the two sides of the recessed passage are provided with a connection hole, two isolation plates which are in parallel are mounted within the seat body and the width between the two isolation plates is that the two sides of the positioning side urge in parallel, the front edge of the two isolation plates are provided with two screw holes for the mounting of two screws to the connection holes so as to connect the top fastening plate to the front edge of the isolation plate.

Yet another object of the present invention is to provide a coupling device for sanitary fittings, wherein the mounting of the seat body is convenient and the mounting is secured.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
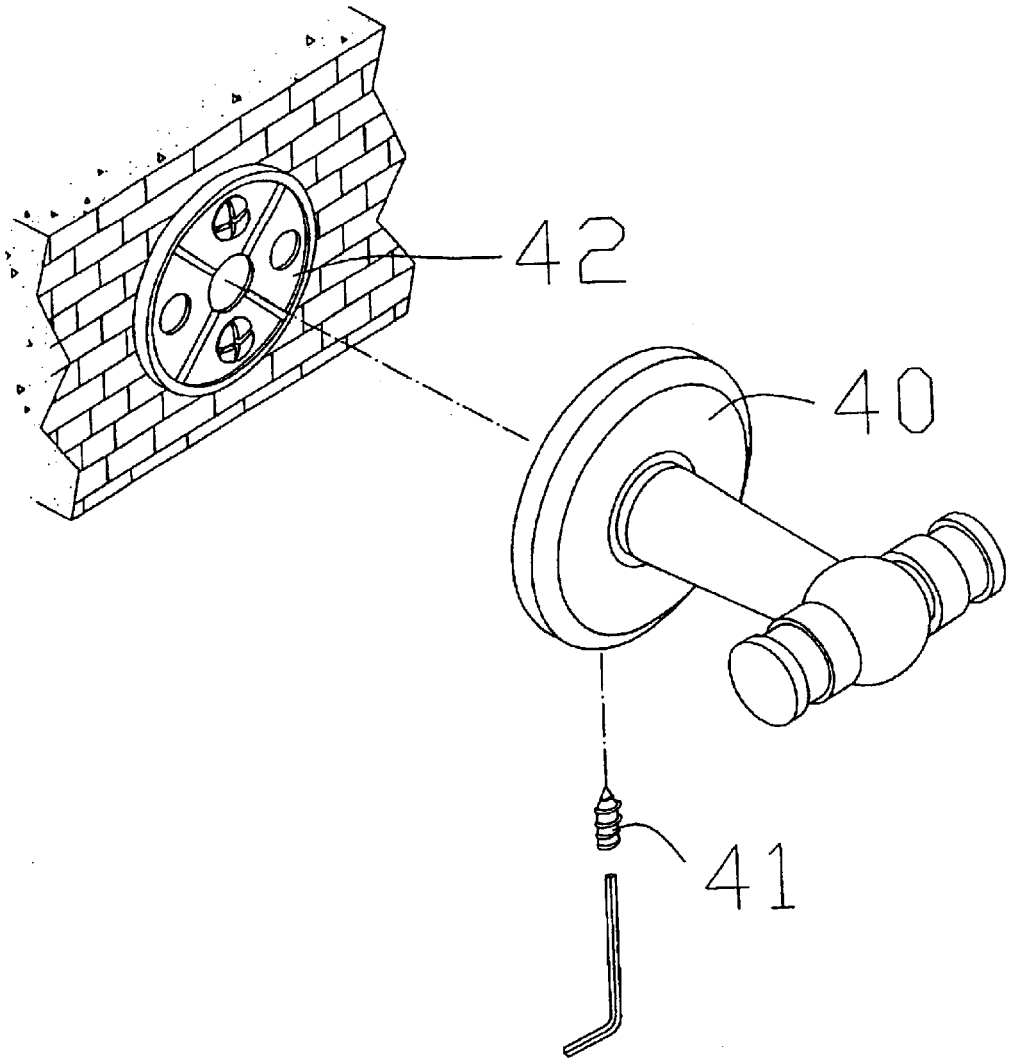
PRIOR ART FIG. 1
FIG. 1 is a perspective view of a conventional coupling device for a sanitary fitting.
Figure 2:
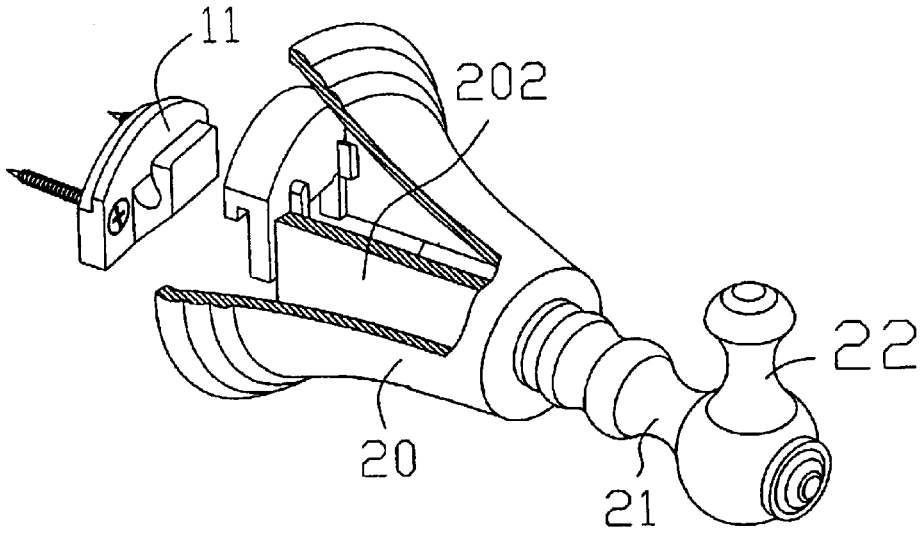
FIG. 2 is a partial sectional view of the coupling device of the present invention.
Figure 3:
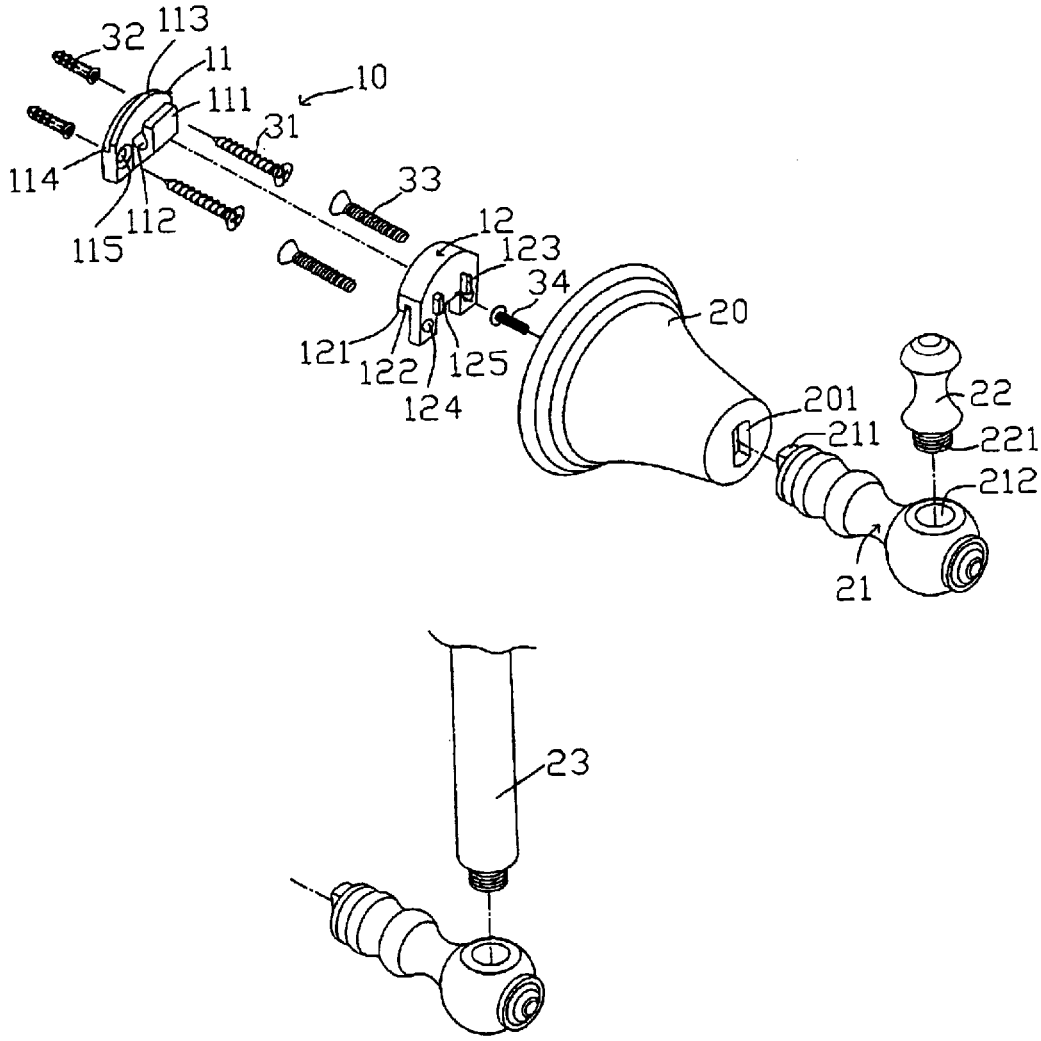
FIG. 3 is a perspective exploded view of the coupling device of the present invention FIGS. 4 and 5 schematically show the implementation of the coupling device in accordance with the present invention.

Referring to FIGS. 2 and 3, there is shown a coupling device used for mounting sanitary fittings having a seat body 20 including a main body 10, a rod body 21 and a hook body 22. The upper end face of the seat body 20 is provided with a positioning slot 201, and the main body 10 comprises a bottom fastening plate 11 and a top fastening plate 12. A bottom-protruded edge 113 is located at the upper edge side of the bottom fastening plate 11 and the bottom edge is a fastening side 114. At the center of the bottom fastening plate 11 corresponding to that of the top fastening plate 12 is a hook-like fastening block 111 having a fastening slot 112. The two sides of the corresponding top and bottom fastening plate 11, 12 are provided with a securing hole 115 for the insertion of screw 31 for mounting. A stepped slot is provided at a recessed region on the top fastening plate 12 corresponding to the bottom fastening plate 11, and a top protruded edge 121 is located at the side edge, and a fastening passage 122 is formed within the recessed region of the top fastening plate 12, and the bottom protruded edge 113 of the bottom fastening plate 11 is engaged with the fastening passage 122. A recessed passage 125 is provided at one recessed end face formed on the top fastening plate 12 which correspond to the bottom fastening plate 11, one side of the recessed passage 125 ha two parallel positioning sides and the two sides of the recessed passage 125 are provided with a connection hole 124.

Referring to FIG. 2, the seat body 20 is provided with two parallel isolation plates 202, which, are mounted within the seat body 20. The distance between the two isolation plates 202 is equal to that between the two positioning sides 123. The front edge of the two isolation plates 202 are provided with two screw holes (not shown) for the mounting of two screws 33 to the connection holes 124 so as to connect the top fastening plate 12 to the front edge of the isolation plate 202, the top end face of the seat body 20 is positioned with an elongated positioning slot 201. The bottom end of the positioning slot 201 is provided with a screw hole (not shown). The upper section of the seat body 20 is provided with a rod body 21 for fitting. The rod body 21 corresponding to one end of the seat body 20 is provided with a positioning body 211 for the positioning passage 201 to position through the positioning slot 201 using screw 34 to a locking hole (not shown). The top end of the rod body 21 is provided with a screw connection hole 212 for the mounting with a hook rod 22 or a support rod 23, and allows the screw rod 221 to be inserted into the screw connection hole 212.

Figure 4:
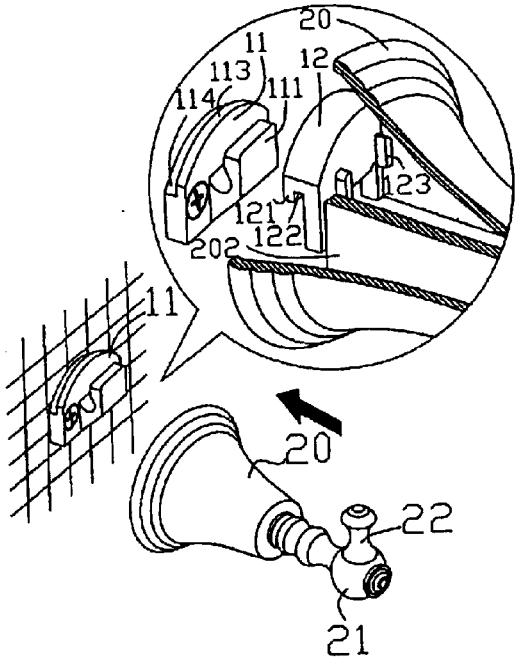
Figure 6A:
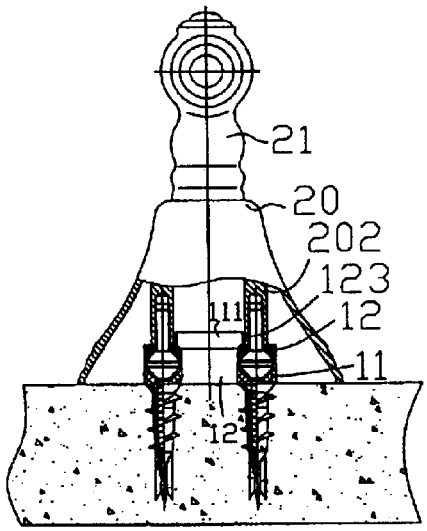
FIGS. 6A and 6B are a sectional view of the coupling device of the present invention.
Figure 6B:
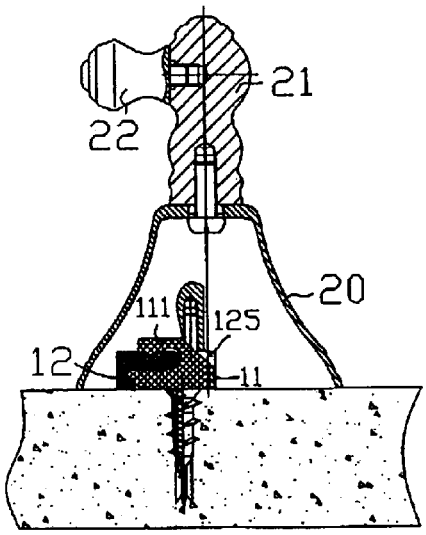

Referring to FIGS. 4, 6A and 6B, there is shown an implementation of the coupling device in accordance with the present invention. As shown in FIG. 4, when the bottom fastening plate 11 is mounted onto a securing face such that the bottom fastening plate 11 is installed into horizontal, and the fastening block 111 of the bottom fastening plate 11 is in a vertical position. At this moment, the positioning of the coupling device is completed. During installation, the seat body 20 together with support rod 23 and the hook body 22 are mounted to the rod body 21 of the sanitary fitting and a screw 34 secures the rod body 21 onto the seat body 20. The positioning side 123 of the top fastening plate 12 is engaged with the inner edge of the isolation plate 202 of the seat body 20 and a screw 33 is used to fasten the top fastening plate 12 onto the top edge of the isolation plate 202.

Figure 5:
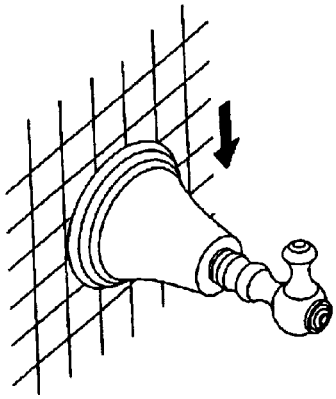

As shown in FIG. 5, the seat body 20 is held with one hand, the fastening block 111 is inserted into the recessed passage 125 of the top fastening plate 12 such that the protruded edge 121 of the top fastening plate 12 and the fastening passage 122 are aligned and positioned with the bottom protruded edge 113 of the bottom fastening plate 11 and the fastening side 114. The seat body 20 is vertically urged so that the fastening slot 112 is urged with the recessed passage 125 of the top fastening plate 12. At the same time, the top protruded edge 121 of the fastening passage 122 and the bottom-protruded edge 113 of the fastening side 114 are in engagement.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A sanitary fittings having a seat body including a main body, and a rod body and a hook body, wherein an outer end face of the seat body is provided with a positioning slot, and the main body comprises a bottom fastening plate and a top fastening plate, a protruded edge at a front end of the bottom fastening plate being formed with a stepped body and a bottom protruded edge being located at an upper edge side of the bottom fastening plate and the bottom protruded edge being a fastening side, a center of the bottom fastening plate corresponding to that of the top fastening plate being provided with a fastening block having a fastening slot, two sides of the corresponding top and bottom fastening plates being provided with a securing hole for insertion of a screw for mounting, a stepped slot being provided at a recessed region on the top fastening plate corresponding to the bottom fastening plate, a fastening passage being formed within a recessed portion of the top fastening plate, the bottom protruded edge of the bottom fastening plate being engaged with the fastening passage, a recessed passage being provided at one recessed end face formed on the top fastening plate corresponding to the bottom fastening plate, one side of the recessed passage having two positioning sides which are in parallel, two sides of the recessed passage being provided with a connection hole, two isolation plates which are in parallel are mounted within the seat body and a distance between the two isolation plates being equal to that between the two positioning sides, a front edge of the two isolation plates being provided with two screw holes for mounting of two screws to the connection holes so as to connect the top fastening plate to the front edge of the isolation plate.

* * * * *